US011170609B2

(12) United States Patent
Guldenaar et al.

(10) Patent No.: US 11,170,609 B2
(45) Date of Patent: Nov. 9, 2021

(54) SIDE-BET DEVICE AND SYSTEM

(71) Applicant: International Casino Systems Europe BV, Amsterdam (NL)

(72) Inventors: Marco G. N. Guldenaar, Purmerend (NL); Lino Thijssen, Amsterdam (NL)

(73) Assignee: International Casino Systems Europe BV, Amsterdam (NL)

( * ) Notice: Subject to any disclaimer, the term of this patent is extended or adjusted under 35 U.S.C. 154(b) by 0 days.

(21) Appl. No.: 16/593,128

(22) Filed: Oct. 4, 2019

(65) Prior Publication Data

US 2020/0111313 A1 Apr. 9, 2020

Related U.S. Application Data

(60) Provisional application No. 62/741,659, filed on Oct. 5, 2018.

(51) Int. Cl.
*G07F 17/32* (2006.01)

(52) U.S. Cl.
CPC ..... *G07F 17/3258* (2013.01); *G07F 17/322* (2013.01); *G07F 17/3209* (2013.01); *G07F 17/3267* (2013.01); *G07F 17/3293* (2013.01)

(58) Field of Classification Search
CPC ..... G07F 17/3202; G07F 17/3204; G07F 17/3206; G07F 17/3209; G07F 17/3211; G07F 17/3216; G07F 17/322; G07F 17/3225; G07F 17/323; G07F 17/3232; G07F 17/3244; G07F 17/3248; G07F 17/3251; G07F 17/3258; G07F 17/3262; G07F 17/3293; G06Q 50/34
See application file for complete search history.

(56) References Cited

U.S. PATENT DOCUMENTS

| | | | | |
|---|---|---|---|---|
| 6,609,975 | B1 | 8/2003 | Sawyer et al. | |
| 6,929,264 | B2 | 8/2005 | Huard et al. | |
| 8,641,533 | B2 | 2/2014 | Cao | |
| 8,961,298 | B2 | 2/2015 | Czyzewski et al. | |
| 9,747,749 | B1 | 8/2017 | Wisler et al. | |
| 2004/0219969 | A1 * | 11/2004 | Casey | G07F 17/3232 463/20 |

(Continued)

FOREIGN PATENT DOCUMENTS

CA 2243738 A1 1/2000

*Primary Examiner* — Omkar A Deodhar
(74) *Attorney, Agent, or Firm* — The Webb Law Firm

(57) ABSTRACT

Provided is a side-bet device, system, and method. The device includes a housing having a surface, at least one sensing device arranged in the housing and configured to generate sensing device data based on at least one input received through the surface, a display device arranged in the housing and configured to display an electronic balance, and a computing device in communication with the at least one sensing device and the display device, the computing device configured to: detect a first input type from the surface based on the sensing device data received from the at least one sensing device, the first input type including a placement of a wagering unit on the surface, participate in a game by initiating a wager based on detecting the wagering unit and participate in the game by initiating the wager based on transferring a value of the wager from the electronic balance.

19 Claims, 13 Drawing Sheets

(56) References Cited

U.S. PATENT DOCUMENTS

| | | | | |
|---|---|---|---|---|
| 2012/0122559 | A1* | 5/2012 | Kelly | G07F 17/3239 463/25 |
| 2014/0200071 | A1* | 7/2014 | Czyzewski | G07F 17/3204 463/25 |
| 2016/0071367 | A1* | 3/2016 | Litman | G07F 17/322 463/25 |
| 2017/0323514 | A1 | 11/2017 | Czyzewski et al. | |
| 2019/0043315 | A1* | 2/2019 | LaDuca | G07F 17/3267 |

* cited by examiner

SIDE-BET DEVICE AND SYSTEM

CROSS-REFERENCE TO RELATED APPLICATION

This application claims priority to U.S. Provisional Patent Application No. 62/741,659, filed Oct. 5, 2018, the disclosure of which is hereby incorporated by reference in its entirety.

BACKGROUND

Field

This disclosure relates generally to casino games and, in non-limiting embodiments, to a side-bet device and system.

Technical Considerations

U.S. Pat. No. 8,641,533 to Araico Cao, entitled "System and method for playing a progressive jackpot game, and player input device," describes a side-bet device for participating in a side-bet, such as a progressive jackpot, in a casino game. This reference describes a plurality of player input devices for providing an account balance and for providing inputs to participate in the side-bet game.

SUMMARY

According to non-limiting embodiments or aspects, provided is a side-bet device comprising: a housing having a surface; at least one sensing device arranged in the housing and configured to generate sensing device data based on at least one input received through the surface; a display device arranged in the housing and configured to display an electronic balance through the surface; and a computing device internal or external to the housing, the computing device in communication with the at least one sensing device and the display device, the computing device configured to: (a) detect a first input type from the surface based on the sensing device data received from the at least one sensing device, the first input type comprising a placement of a wagering unit on the surface, (b) participate in a game by initiating a wager based on detecting the wagering unit. and (c) participate in the game by initiating the wager based on transferring a value of the wager from the electronic balance.

In non-limiting embodiments, the computing device is further configured to detect a second input type from the at least one sensing device based on the sensing device data received from the at least one sensing device, the second input type comprising a placement of a user's appendage or portion thereof on or within sensing device range of the at least one sensing device. In non-limiting embodiments, the at least one sensing device comprises an infrared transmitter and receiver configured to transmit a signal to be reflected by an object placed on or near the sensing device. In non-limiting embodiments, the first input type comprises a reflection of the signal for a first period of time, and the second input type comprises a reflection of the signal for a second period of time shorter than the first period of time. In non-limiting embodiments, the signal comprises a modulated infrared signal. In non-limiting embodiments, the at least one sensing device comprises a receiver and a transmitter, the transmitter is configured to emit a radiation that is at least partially reflected by the wagering unit, and the receiver is configured to detect the radiation after being reflected.

In non-limiting embodiments, the second transmitter comprises at least one of: an RGB-LED, a white light LED, or any combination of visual light, and at least one of the first receiver and the second receiver comprises at least one of: a luminous sensing device, a color sensing device, a camera, an image sensor, or any combination of sensors that receive visual light. In non-limiting embodiments, the computing device is further configured to add a value to the electronic balance in response to detecting the first input type. In non-limiting embodiments, the sensing device comprises a radio frequency receiver, and the first input type comprises a signal from at least one wagering unit having a radio frequency transmitter embedded therein. In non-limiting embodiments, the display device and the sensing device are arranged directly under the surface. In non-limiting embodiments, at least a portion of the surface is angled and is adapted for receiving a wagering unit placed on it. In non-limiting embodiments, the at least a portion of the surface comprises a raised portion arranged over the at least one sensing device, the raised portion is angled with respect to a flat portion of the surface, and the raised portion comprises a side surface comprising a second display device.

In non-limiting embodiments, the computing device is further configured to detect a second input type from the at least one sensing device based on the sensing device data received from the at least one sensing device, wherein the second input type comprises a placement of a user's appendage or portion thereof on or within sensing device range of the at least one sensing device, and wherein the computing device is further configured to transfer a value from the electronic balance to a separate side-bet electronic balance in response to the first input or the second input type. In non-limiting embodiments, the display device is further configured to display the separate side-bet balance. In non-limiting embodiments, the computing device comprises a first computing device arranged in the housing and a second computing device in communication with a plurality of side-bet devices, wherein the second computing device is located external to the housing. In non-limiting embodiments or aspects, the side-bet device further comprises at least one visual indicator arranged on or in the housing, the at least one visual indicator configured to display a plurality of different visual states in response to input from the user or the computing device.

According to non-limiting embodiments or aspects, provided is a computer program product for operating a side-bet game, comprising at least one non-transitory computer-readable medium including program instructions that, when executed by at least one processor, cause the at least one processor to: enter a betting-allowed phase of a game based on input received through a dealer input device, wherein a plurality of side-bet devices is in communication with the dealer input device; display, on a display device, an electronic balance on a side-bet device used during the side-bet game; during the betting-allowed phase, detect, with at least one sensing device arranged under a surface of the side-bet device, a first input type from the surface comprising a placement of at least one wagering unit on the surface; determine a value of the at least one wagering unit based on sensing device data received from the at least one sensing device; in response to a player input to wager from the at least one wagering unit, allocate the value or a portion thereof for the side-bet device to a side-bet of a primary game being conducted; in response to a player input to wager from the electronic balance, allocate at least a portion of the electronic balance for the side-bet device to the side bet; and enter a betting-not-allowed phase, wherein further input from the surface during the betting-not-allowed phase is not registered as a wager or an addition to the electronic balance, and wherein entering the betting-not-allowed phase comprises registering the allocated value as a wager to be used in the side-bet game.

In non-limiting embodiments or aspects, detecting the first input type comprises: transmitting, from a transmitter, a signal to the surface of the side-bet device; and receiving, from the surface by the at least one sensing device, a reflection of the signal. In non-limiting embodiments or aspects, wherein detecting the first input type comprises: transmitting, from a transmitter, a signal to the surface of the side-bet device; and receiving, from the surface by the at least one sensing device, a second signal responsive to the signal. In non-limiting embodiments or aspects, the program instructions, when executed, further cause the at least one processor to activate at least one visual indicator to display a different visual state based on whether a wager is allocated to the side-bet through each side-bet device, and the different visual state is changed to a further visual state in response to entering the betting not allowed phase.

According to non-limiting embodiments or aspects, provided is a method for operating a side-bet game, comprising: entering, with at least one processor, a betting-allowed phase of a game based on input received through a dealer input device; during the betting-allowed phase, detecting, with at least one sensing device arranged under a surface of a side-bet device, a first input type from the surface comprising a placement of at least one wagering unit on the surface; determining, with at least one processor, a value of the at least one wagering unit based on sensing device data received from the at least one sensing device; transferring, with at least one processor, the value from the at least one wagering unit to an electronic player balance of the side-bet device; register participation in a side-bet game based on user input on the surface if there are sufficient credits on the electronic player balance to participate in the side bet game; entering, with at least one processor, a betting-not-allowed phase in response to input received through a dealer input device, wherein further user input from the surface on the side-bet device during the betting-not-allowed phase is not registered as a wager or an addition to the electronic balance, and wherein entering the betting-not-allowed phase comprises deducting at least a portion of the value added to the balance of the side-bet device.

In non-limiting embodiments or aspects, wherein detecting the first input type comprises: transmitting, from a transmitter, a signal to the surface of the side-bet device; and receiving, from the surface by the at least one sensing device, a reflection of the signal. In non-limiting embodiments or aspects, wherein detecting the first input type comprises: transmitting, from a transmitter, a signal to the surface of the side-bet device; and receiving, from the surface by the at least one sensing device, a second signal responsive to the signal.

According to non-limiting embodiments or aspects, provided is a side-bet device comprising: a housing adapted to be arranged on or within a planar surface; an angled surface arranged on an upper side of the housing, the angled surface at least partially angled with respect to the planar surface when the housing is arranged on or within the planar surface; at least one sensing device arranged in the housing and directly under the angled surface, the at least one sensing device configured to generate sensing device data based on at least one input; and a computing device in communication with the at least one sensing device, the computing device configured to detect a first input type from the surface based on the sensing device data received from the at least one sensing device, the first input type comprising a placement of a wagering unit on the surface. In non-limiting embodiments or aspects, the housing is flush with the planar surface, and the angled surface is raised above the planar surface and the housing.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a," "an," and "the" include plural referents unless the context clearly dictates otherwise.

DETAILED DESCRIPTION

Figure 1:
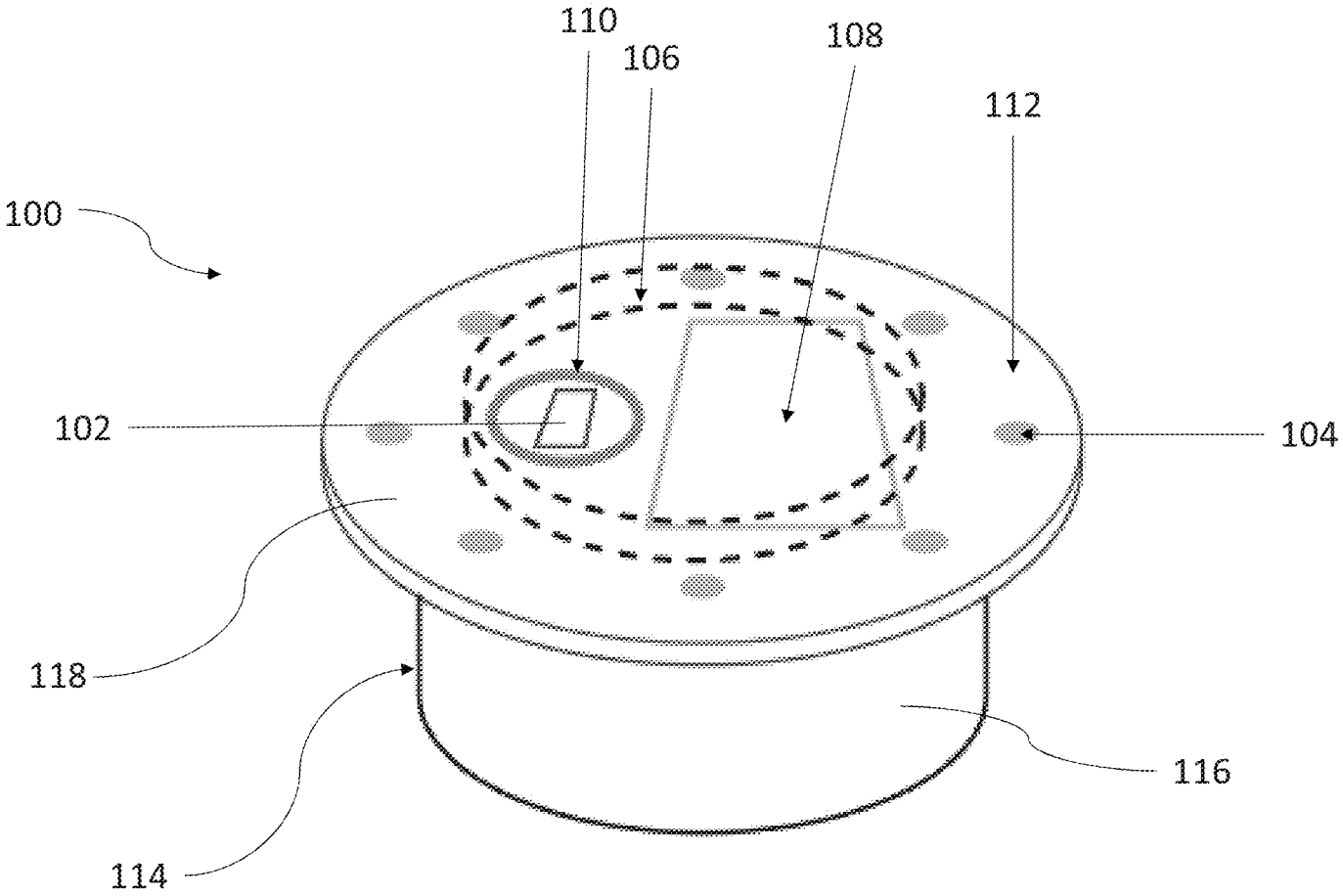
FIG. 1 illustrates a side-bet device according to a non-limiting embodiment.

For purposes of the description hereinafter, the terms "end," "upper," "lower," "right," "left," "vertical," "horizontal," "top," "bottom," "lateral," "longitudinal," and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

As used herein, the terms "communication" and "communicate" may refer to the reception, receipt, transmission, transfer, provision, and/or the like, of information (e.g., data, signals, messages, instructions, commands, and/or the like). For one unit (e.g., a device, a system, a component of a device or system, combinations thereof, and/or the like) to be in communication with another unit means that the one unit is able to directly or indirectly receive information from and/or transmit information to the other unit. This may refer to a direct or indirect connection (e.g., a direct communication connection, an indirect communication connection, and/or the like) that is wired and/or wireless in nature. Additionally, two units may be in communication with each other even though the information transmitted may be modified, processed, relayed, and/or routed between the first and second unit. For example, a first unit may be in communication with a second unit even though the first unit passively receives information and does not actively transmit information to the second unit. As another example, a first unit may be in communication with a second unit if at least one intermediary unit (e.g., a third unit located between the first unit and the second unit) processes information received from the first unit and communicates the processed information to the second unit. In some non-limiting embodiments, a message may refer to a network packet (e.g., a data packet and/or the like) that includes data. It will be appreciated that numerous other arrangements are possible.

Non-limiting embodiments are directed to a side-bet device that displays a player balance, allows for player participation in a side-bet game, and/or detects the placement of one or more wagering units, such as betting chips, coins, tokens, etc., for the side-bet game. In non-limiting embodiments, a player's willingness to participate in a game is registered by touching or moving an appendage or portion thereof (e.g., a hand, finger, or the like) above the area where the wagering units are placed. In non-limiting embodiments, the registration is effectuated by a modulated infrared signal that is reflected and further identified by an infrared receiver.

In non-limiting embodiments, the side-bet device described herein may be used in the games and with the systems described in U.S. Pat. No. 8,641,533 to Araico Cao, entitled "System and method for playing a progressive jackpot game, and player input device," which is hereby incorporated by reference in its entirety. The side-bet device may be used in the progressive jackpot game and the phases of that game described in that patent reference. Moreover, the technological architecture described in that patent reference may also be used in connection with the side-bet device described herein.

Non-limiting embodiments of the side-bet device described herein allow for players to choose whether they prefer to place a separate wagering unit on an area designated to receive the wagering unit or to utilize an electronic balance of credits, thereby allowing the player to play one game or several successive games. In non-limiting embodiments, this choice occurs during a betting-allowed game phase (e.g., a portion of the game during which bets can be placed by players). In non-limiting embodiments, the side-bet device includes one or more sensing devices configured to detect one or more inputs. For example, one or more sensing devices may be used to detect the placement of a wagering unit on an area designed to receive the wagering unit, the placement of a user hand or finger on or near the side-bet device to provide an input, and/or other inputs from a player. In non-limiting embodiments, one or more sensing devices may be a touch screen.

In some non-limiting embodiments, a sensing device uses optical techniques to detect the wagering unit and/or the value of the wagering unit based on its color, pattern, and/or design. For example, in non-limiting embodiments, an IR transmitter and receiver arranged within a side-bet device may communicate a modulated IR signal that is reflected at the other side of a surface (e.g., a transparent or translucent glass or plastic surface) of the side-bet device when one or more wagering units are placed on the surface. Since the modulation (e.g., a specific bit sequence of the IR light) of the wagering unit placed on the surface can be determined by the side-bet device (e.g., can be determined by a processor in or in communication with the side-bet device), it can be used for the identification of the reflected IR light by comparing the received signal with one or more known modulations. Accordingly, in such non-limiting embodiments, the IR receiver is able to distinguish between the reflected IR signal sent by the transmitter and surrounding IR light which originates from other light sources.

In some non-limiting embodiments, a sensing device uses radio frequencies to detect the wagering unit and/or the value of the wagering unit. For example, a wagering unit may include an RFID transponder that is activated by an RFID reader incorporated into the side-bet device. The RFID transponder may communicate wagering unit data indicating a value, an identifier, and/or the like. In non-limiting embodiments, an RFID reader may detect multiple wagering units stacked on top of one another at the same location on the side-bet device, allowing a player to add the aggregate values of multiple wagering units. It will be appreciated that various other arrangements are possible.

In non-limiting embodiments, the wagering unit is detected via prolonged detection of the same modulated IR signal (e.g., a signal is received for at least a threshold period of time). This is enabled by the wagering unit continuously or continually emitting the same modulated IR signal from the same location, whereas a human interaction with IR receivers, or other interfering signals, is relatively temporal. In some non-limiting embodiments, the wagering unit may be detected via additional light emitters and sensing devices that can distinguish different wagering unit values. This may be achieved by using a white light with different color sensing devices, a RBG light with a luminance sensing device, and/or an ultraviolet emitter and sensing device combined with a UV pattern for a wagering unit. In some non-limiting embodiments, the white or RBG lights may only be used when a wagering unit is on top of the surface or area of the surface, which would reduce disturbance to the public. In some non-limiting embodiments, the wagering unit can be detected by a camera and a white LED below the wagering unit.

Referring now to FIG. 1, a side-bet device 100 is shown according to a non-limiting embodiment. The side-bet device 100 includes a housing 114 that contains one or more components of the side-bet device 100. The housing 114 includes a lower portion 116 that is adapted to be received by or inset into a planar surface, such as a gaming table. The housing 114 also includes an upper portion 118 that is adapted to be visible on the planar surface in which the side-bet device 100 is installed. It will be appreciated that, in some non-limiting embodiments, the housing 114 may be part of a larger housing such as, for example, embodiments in which the side-bet device 100 is integrated into a gaming table (e.g., where the gaming table forms the housing) and/or embodiments in which numerous side-bet devices 100 share a common housing. Various other configurations are possible. In the non-limiting embodiment shown in FIG. 1, a sensing device 102 is shown arranged in an area 110 designated for player input. The sensing device 102 may be an IR transmitter and receiver, for example. In non-limiting embodiments, the sensing device 102 may be used as the sole detection mechanism for recognition of both the player input and/or placement of wagering units. As an example, a player input may be associated with a temporary light reflection from the player touching or passing his or her hand over an area 110 designated for input (e.g., a virtual button). A wagering unit may be associated with a longer light reflection because the wagering unit may remain on the area 110 until someone picks up the wagering unit. Accordingly, one or more predetermined threshold durations of light reflectance may be utilized to distinguish between a player input and the placement of a wagering unit. For example, a short duration (e.g., less than 1-5 seconds) may indicate a player input such as a touch or a hand pass, whereas a long duration (e.g., more than 1-5 seconds) may indicate the placement of a wagering unit. In non-limiting embodiments, a short duration (e.g., 3-5 seconds) may set the system into an auto-bet mode. In non-limiting embodiments, the auto-bet mode may be the default mode for the side-bet device 100, and the player, in such a mode, may interact with the sensing device 102 in order to opt out of the next game. In non-limiting embodiments, a brief duration (e.g., 1-3 seconds) may cancel a placed bet. In non-limiting embodiments, the side-bet device 100 includes multiple sensing devices designated for multiple players' input.

With continued reference to FIG. 1, the side-bet device 100 may also include one or more LEDs or other visual indicators 104, such as RGB-LEDs or white LEDs, arranged on the housing 114 of the side-bet device 100. The visual indicators 104 may include any device configured to display at least two visual states (e.g., on or off) and, in some cases, may display a plurality of different visual states (e.g., patterns, colors, sequences, and/or the like). In some non-limiting embodiments, the visual indicators 104 may be arranged underneath a translucent surface or any other type of surface that diffuses the light from the visual indicators 104 and illuminates a solid color of light in an area 112. Further, in some non-limiting embodiments, the visual indicators 104 may include or be accompanied by a display device that displays text, symbols, and/or numbers to explain the meaning of the different visual states (e.g., light sequence and/or colors) of the visual indicators 104. The side-bet device 100 may also include a surface 106, such as a transparent or translucent glass or plastic surface, under which the sensing device 102 may be placed. The side-bet device 100 may further include a display device 108 for displaying an electronic player balance (e.g., an amount of currency or a number of credits). In non-limiting embodiments, the display device 108 may be arranged under the surface 106 such that the balance is displayed through the surface 106 to the player. The display device 108 may include an OLED display device or any other suitable display device. It will also be appreciated that the display device 108 may be arranged elsewhere, such as on an upper portion 118 of the housing 114.

Figure 2:
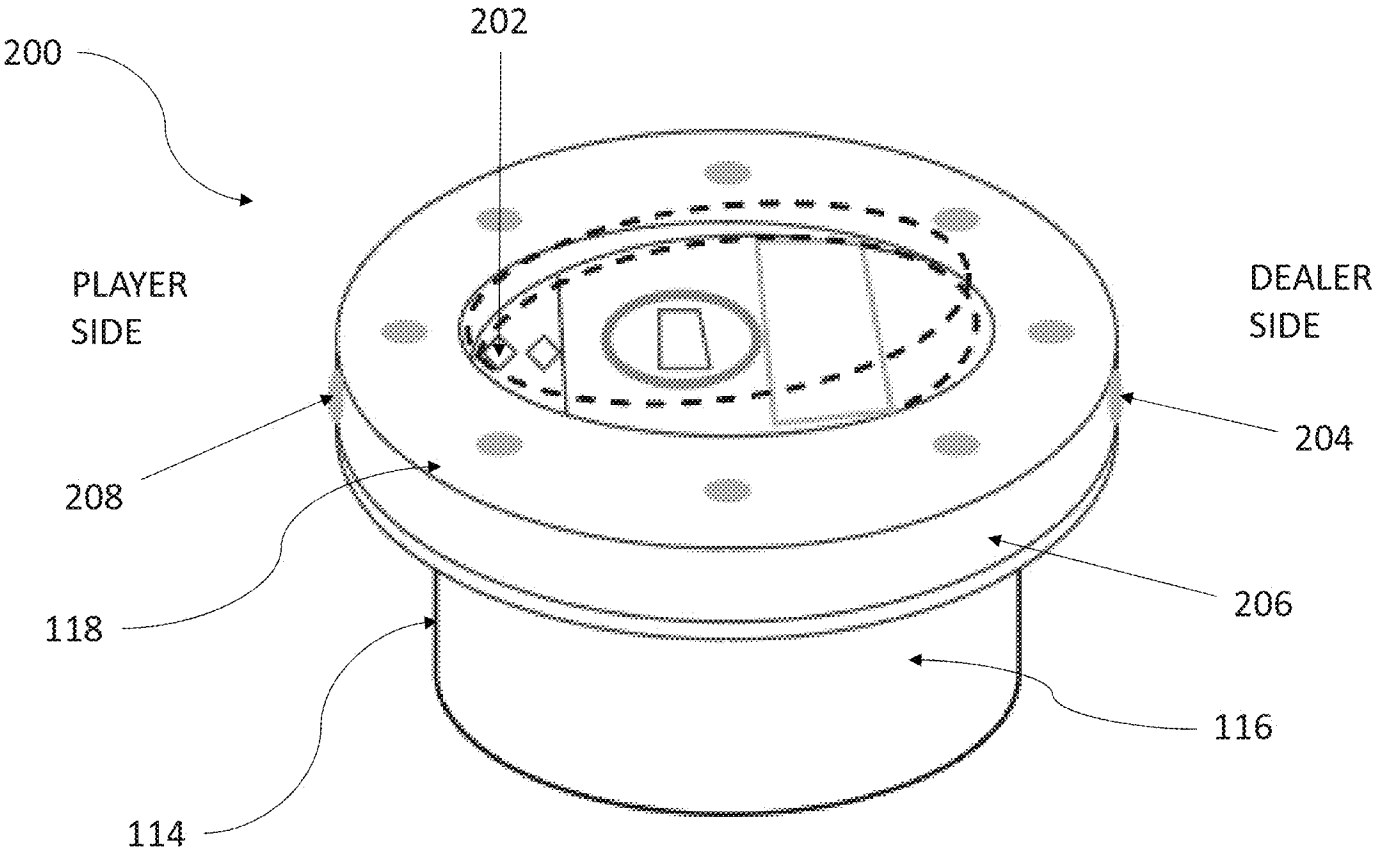
FIG. 2 illustrates a side-bet device according to a non-limiting embodiment.

With reference to FIG. 2, in non-limiting embodiments, the surface 106 and/or area 110 (e.g., a portion of the surface) of a side-bet device 200 may be angled (e.g., tilted and/or asymmetric) with respect to the upper portion 118 of the housing and/or a planar surface in which the side-bet device 100 is installed. For example, the surface 106 may be raised and/or asymmetric such that a wagering unit has to be placed in one or more particular positions (e.g., balanced or stabilized). In this manner, the area 110 and/or surface 106 may be arranged such that the sensing device 102 is aligned with the wagering unit and therefore the detections are more precise. Further, an angled and/or raised area 110 and/or surface 106 may facilitate a dealer to easily pick up the wagering unit, making the game faster and more efficient.

With continued reference to FIG. 2, in non-limiting embodiments the housing 114 may be raised such as to provide a vertical or near-vertical surface 206 viewable by the dealer which may incorporate an indicator 204, such as an additional display device, configured to display information (e.g., wagering unit value, balance, input, etc.) to the dealer. The surface 206 and/or indicator 204 may also be arranged under a raised end of the surface 106 in non-limiting embodiments in which the surface 106 is angled. The surface 206 and/or an indicator 204 on the dealer-facing side of the side-betting device may also convey information through the illumination of indicators with specific colors and/or patterns. In some non-limiting embodiments, the indicator 204, surface 206, and/or other display device 208 may also be on the player-facing side. A player-facing display device 208 may be additional to the display device 108 and/or used instead of a display device 108 arranged underneath the surface 106. The visual indicators 104 arranged around the side-bet device 200 may also convey such information based on patterns, signals, and/or colors. Enabling the dealer to check the identified value of the wagering unit at the same location where the dealer must pick up the wagering unit ensures a quick and safe casino operation. In non-limiting embodiments, the indicators 104, surface 106, display devices 204, 208, and/or other indicators may display a color corresponding to a color of the wagering unit placed on the side-bet device 200. Other arrangements are possible.

With continued reference to FIG. 2, in non-limiting embodiments, visual indicators 104 may change colors or patterns depending on the phases of the game. For example, the color red may be used to indicate that the player can no longer place wagers (e.g., betting-not-allowed phase) or that a game has started. Other game phases may include pre-betting-allowed phase, betting-allowed phase, winner definition phase, or jackpot winner phase. In non-limiting embodiments, the color change of visual indicators 104 may occur anywhere on the side-bet device. In non-limiting embodiments, visual indicators 104 may change colors or patterns to indicate that the player is a winner. The winning indication may indicate that the player either won a jackpot or any other winning event. Different winning events may have different indications. The winning indication may last until the next game phase begins, for a predetermined amount of time, or until the player provides new input into the device. In other non-limiting embodiments, when a player has placed wagering units on the side-bet device 200 during a betting-not-allowed phase, the dealer is prompted to remove the wagering units. For example, prompting the dealer to remove the wagering unit may include blinking a visual indicator 104 near the placed wagering units. In other non-limiting embodiments, the dealer may remove the wagering units, upon being prompted, for the next game. In non-limiting embodiments, the visual indicators 104 may change states to indicate a wagering unit has been placed during the betting-allowed phase or that a player has entered a bet by using their appendage (e.g., a hand, finger, or portion thereof) to interact with the side-bet device. The visual indicators 104 may change states again once the bet is considered to be a valid bet for the game. The visual indicators 104 may then change states when the wagering unit is removed by the dealer.

Figure 3:
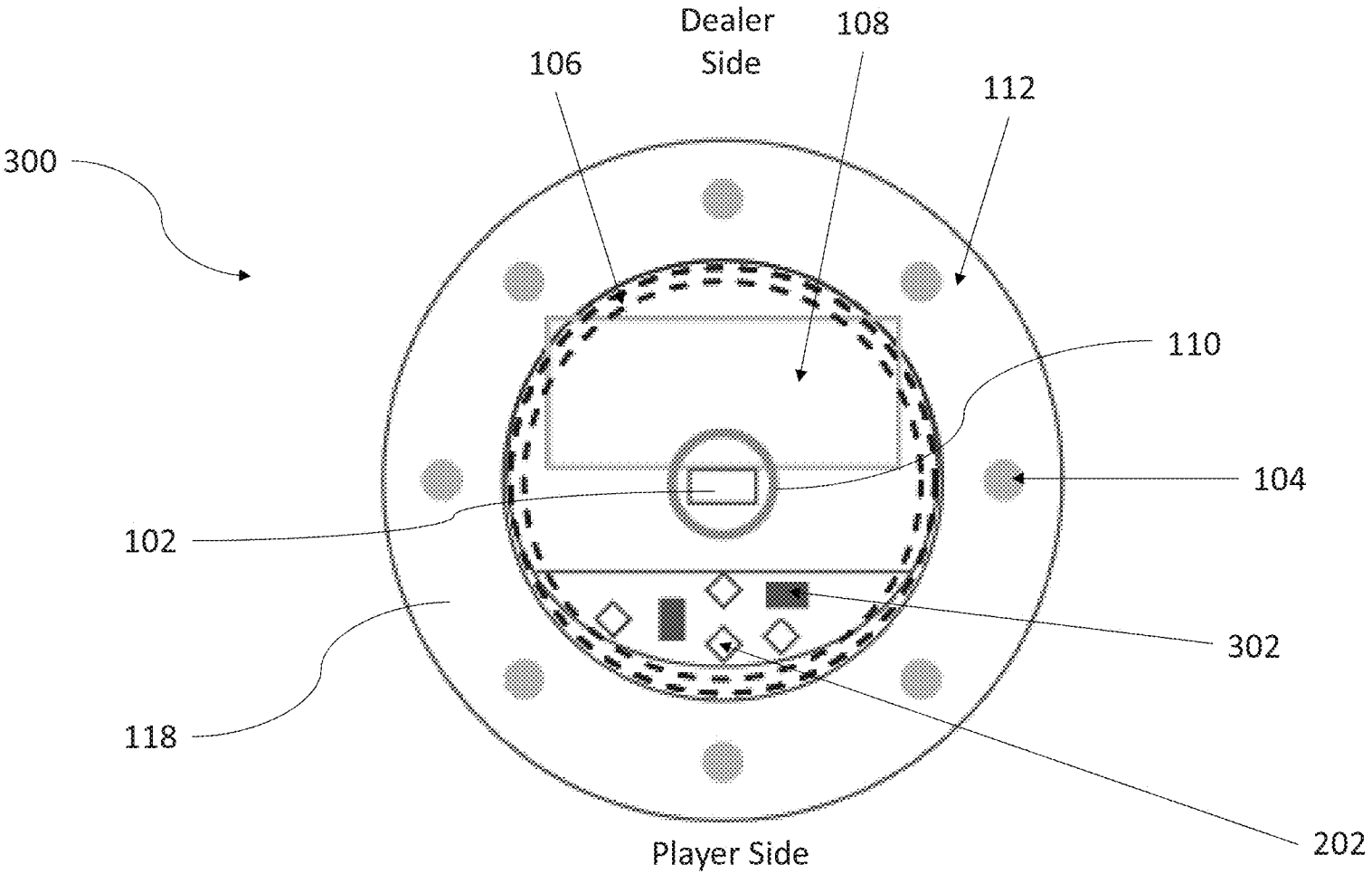
FIG. 3 illustrates a side-bet device according to a non-limiting embodiment.

Referring now to FIG. 3, a side-bet device 300 is shown according to a non-limiting embodiment. In this example, the side-bet device 300 includes multiple sensing devices, including a first sensing device 102 and a second sensing device 302. The visual indicator 202 may be arranged within the side-bet device 300 (e.g., under the surface 106) such that it is detectable by the second sensing device 302. The visual indicator 202 may be an RGB-LED or white LED, for example, and the second sensing device 302 may be a luminance sensing device or one or more color sensing devices. For example, with a white LED 202, a color sensing device can sense, at different positions, which colors are adsorbed and which colors are reflected by the wagering unit placed on the area 110, allowing for the identification of the value of the wagering unit. In non-limiting embodiments, a similar analysis is performed by transmitting a specific sequence of different RGB colors from an LED and measuring the luminance at different positions enabling the identification of which colors are adsorbed and which are reflected at different positions at the side-bet device. Other non-limiting embodiments may include a non-visual light emitter enabling the side-bet device 300 (such as a computing device associated therewith) to measure the existence of specific authenticity characteristics of the wagering units.

With continued reference to FIG. 3, in non-limiting embodiments in which multiple sensing devices 102, 302 are used for distinguishing between player input and wagering units, a modulated IR signal reflected by a wagering unit may be detected by the first receiver at position 102, but also by the second sensing device 302 at, for example, a position over the sensing device 302 (e.g., directly over the sensing device in a vertical alignment). However, when a player input is provided, the second receiver 302 may not receive the modulated IR-signal because it may not be reflected by the player input, rather being reflected only by the wagering unit. In non-limiting embodiments, the sensing device 102 may include a plurality of receivers and transmitters arranged asymmetrically in the side-bet device 300 to allow a wide range of different patterns. Various other arrangements are possible.

In some non-limiting embodiments, the side-bet device includes a computing device and memory. In some non-limiting embodiments, a central processor and/or memory is in communication with each of a plurality of side-bet devices. In some non-limiting embodiments, the sensing devices and/or processor may be calibrated during a learning process performed during set-up or installation. Measured colors and/or patterns corresponding to different wagering unit values may be stored in a database in the memory of a central computer system in communication with the side-bet device, stored in local memory of the side-bet device, and/or stored in memory associated with the casino table or location in which the side-bet device is located. This memory can be queried by the processor when receiving sensing device data from one or more sensing devices.

In non-limiting embodiments, if an electronic player balance has a sufficient balance, the player has the opportunity before starting a game to decide whether or not to participate in (e.g., to join or skip) the side-bet game by player input (e.g., pressing a physical or virtual button, actuating a switch, waving a hand or finger over a sensing device, and/or the like). If an electronic player balance is zero or insufficient to participate in a side-bet, the player may participate in the side-bet by placing a wagering unit on the side-bet device. The wagering unit placement may also indicate the player's participation in the next upcoming side-bet game. At a point when the dealer determines the game-phase for providing player input is complete (e.g., a betting allowed game phase is over) and provides dealer input, the side-bet device may display a state corresponding to the next game phase in which the bets are locked (e.g., a betting-not-allowed phase in which no additional wagers permitted for the current game). The dealer may remove the wagering units while the display device shows the value of the wagering unit adjacent to the number of side-bet games allowed to be played with that value, deducted by a value for playing the game that is already taking place. For example, if the value of the wagering unit allows participation in one side-bet game, the side-bet device will allow the upcoming side-bet game and the electronic balance will show the value as zero or insufficient for subsequent side-bet games. If the identified value of the wagering unit is incorrect, the dealer may provide input into a central dealer input screen (e.g., at the gaming table or elsewhere) for information on the correct value of the wagering unit. Such error and/or misinformation by the system may be recorded in a log for maintenance purposes.

In non-limiting embodiments, a player may place a wagering unit on the side-bet device when the player's balance shows available credits. In this example, the dealer may pick up wagering units directly after they are placed on the side-bet device and the display device may, in response to the wagering units being removed, show the new credit value which is the old value increased by the amount of the wagering unit(s). In this case, the dealer may have an option to lock a specific side-bet device based on input provided to the dealer input device prior to picking up the wagering unit. By this means, the side-bet device or an associated processor may distinguish between a situation in which the dealer has picked up the wagering unit and a situation in which the player has withdrawn his or her bet. In non-limiting embodiments, when a wager unit is placed on the side-bet device, and once the wagering unit is removed, the dealer display device will provide the dealer the option to accept the wager unit and increase the electronic balance by the value of the wagering unit, or decline the wager unit and keep the electronic balance to its original value. In such non-limiting embodiments, it is possible that the display device for displaying the electronic player balance may not be arranged under the area designated for placing wagering units (e.g., item 106 in FIGS. 1 and 2), but rather may be arranged in front of the player on the upper portion 118 of the housing 114 or elsewhere. In some non-limiting embodiments, two or more display devices may be used and arranged on or in the side-bet device to display the electronic balance on two or more locations, such as the alternate location 208 shown in FIG. 2.

In non-limiting embodiments, the side-bet device may permit a player to make multiple wagers. For example, players may be allowed to play with one, two, or three credits, or any other combination of credits, on the same bet such that higher payouts are possible. This choice may be made by the player providing multiple player inputs on the designated player input area of the side-bet device or by utilizing multiple player input areas. With such an arrangement, the display device 108 may show the number of credits available to the player as well as the number of credits used for the next upcoming side-bet game. As an example, this may use, but does not require, two display devices instead of one display device. Alternatively or additionally, the number of credits may be displayed for the upcoming game using the visual indicators (e.g., item 104 in FIGS. 1-3) through the use of different colors or different light patterns. As a non-limiting example, one possible implementation would be to use one, two, or three flashes of light moving around the side-bet device during a betting-allowed game phase, or one, two, three, or more areas may be constantly illuminated in a betting-not-allowed game phase. Various other arrangements are possible.

In non-limiting embodiments, multiple wagers may be placed without using an additional display device for showing the amount wagered and without needing multiple player input areas. For example, a player may add a wagering unit on the side-bet device while he or she is playing the side-bet game. The total value of the wager may be one credit from the electronic player balance plus the value of the wagering unit(s) placed on the side-bet device while playing the side-bet game. In some non-limiting embodiments, wagering in this situation is only permitted when the credit meter is greater than zero or at least equal to a minimum wager. When the credit meter is zero or less than a minimum wager, the player may ask the dealer to refill or replenish the electronic balance, and the player may do so by offering a wagering unit during the betting-allowed phase on the side-bet device while it is zero or less than a minimum wager. The dealer in this example may remove the wagering unit during the same betting-allowed phase, which will increment the electronic balance. Once the electronic balance is refilled or replenished, multiple wagers are made possible again by the placement of one or more additional wagering units.

In non-limiting embodiments, a player may ask the dealer to increase the electronic balance, and the payer may do so by offering a wagering unit during the betting-allowed phase on the side-bet device or through a transaction with the dealer. In non-limiting embodiments, the wagered amount may be indicated by visual indicators 104. In some non-limiting embodiments, a player may choose to participate in a side-bet game by placing one or more wagering units on the side-bet device without replenishing the electronic balance. In some non-limiting embodiments, a player may choose to participate in the side-bet game by placing wagering units on the side-bet device even when the credit meter is not zero or less than a minimum wager. By giving players options to participate in side-bet games with the electronic player balance and/or by placing additional wagering units on the side-bet device, the pace of the game is increased. A player may choose to participate in the side-bet game during the betting-allowed game phases. In non-limiting embodiments, the player may elect to use a fraction of the wagering unit as a bet on the side-bet device. It will be appreciated that, in non-limiting embodiments, a player may choose to participate in a side-bet game at any time permitted by the dealer and/or rules for the game.

Figure 4:
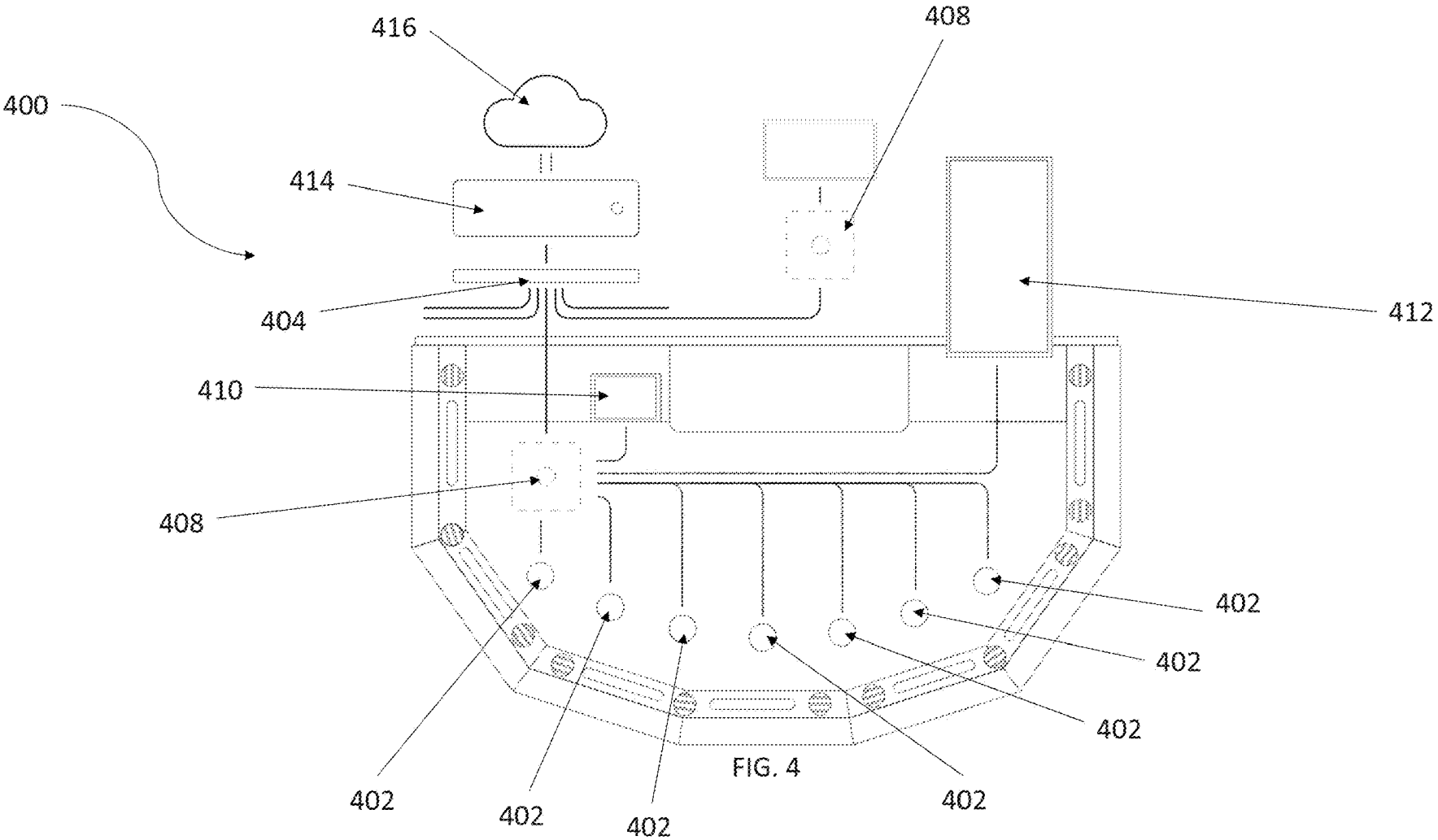
FIG. 4 illustrates a gaming table supporting a plurality of side-bet devices according to a non-limiting embodiment.

Referring now to FIG. 4, shown is a gaming table 400 according to a non-limiting embodiment. The table includes a plurality of side-bet devices 402, a main computing device 404, a side-bet computing device 408, a dealer input device 410, and a player game display device 412. The computing device 404 may include a processor such as a CPU, microprocessor, controller, or any other type of data processing device. The computing device 404 may be in communication with a remote server 414 through a network environment. The remote server 414 may have access to network storage 416, e.g., a "cloud" storage array, for storing data provided from the computing device 404. In some non-limiting embodiments, the network storage 416 may be located in a casino and/or may be controlled by a casino operator, may serve multiple casinos run by the same entity, and/or other like arrangements. In some non-limiting embodiments, a plurality of gaming tables in a casino or area may be connected via the computing device 404 for each table, allowing the game operator to offer a side-bet game utilizing an accumulated jackpot among multiple gaming tables. The side-bet computing device 408 may include a CPU, microprocessor, controller, circuit, or other data processing device that controls one or more aspects of the side-bet game and may act as an interface between the individual side-bet devices 402, dealer input device 410, player game display device 412, and the computing device 404 and/or remote server 414. In some non-limiting embodiments, the computing device 404 and the side-bet computing device 408 may be the same computing device. The remote server 414 may be any server located remotely from the table, such as a server in the same facility or a server external to the facility.

In non-limiting embodiments, the side-bet computing device 408 may include and/or be in communication with a separate display and/or separate input device. The separate device display and input device(s) may allow changes to be made to the side-bet device settings, monitoring of the game situation, servicing of the side-bet device, registration of jackpots, and/or game-analysis, as examples.

In non-limiting embodiments, the remote server 414 may connect to the Internet or other network for provide virtual gaming. The remote server 414 may be able to receive input from different casino locations and combine jackpots from multiple casinos. The computing device 404 may also be connected to jackpot displays independent of the tables. The jackpot displays may show the current jackpot amounts. In non-limiting embodiments, the computing device 408 and/or 404 may facilitate game settings and game management tools.

In non-limiting embodiments, the side-bet device described herein may be used to play any variety of wagering games. For example, even though referred to as a side-bet device, the side-bet device described herein may also be used to make wagers on a principle wagering game and/or a side-bet wagering game that accompanies a principle wagering game.

Figure 6:
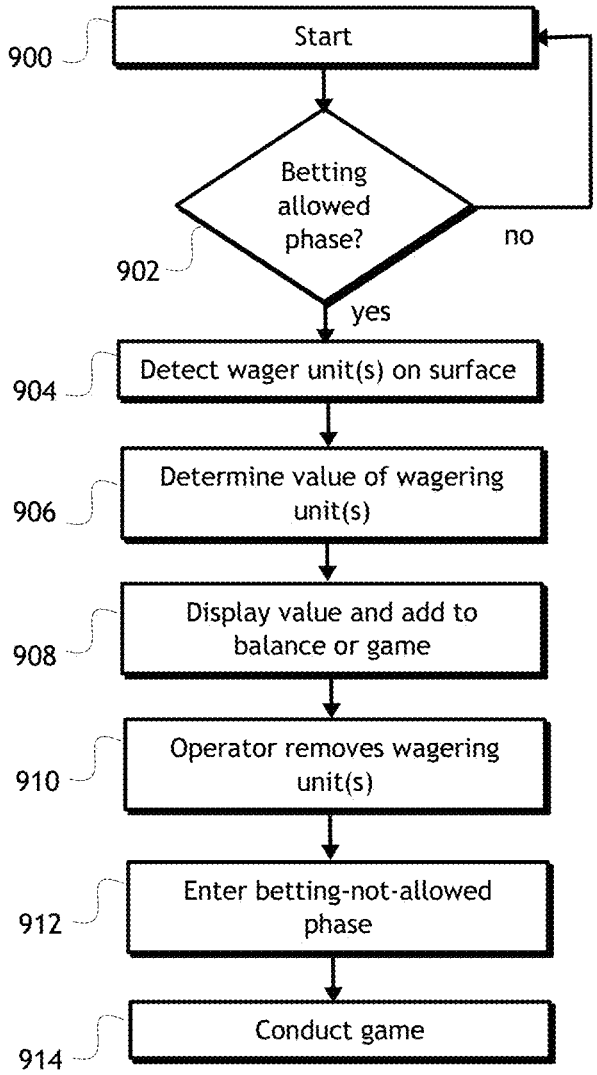
FIG. 6 illustrates a flow diagram for a method for providing a side-bet game according to a non-limiting embodiment.

Referring now to FIG. 6, a flow chart for operating a side-bet device is shown according to a non-limiting embodiment. It will be appreciated that, in some non-limiting embodiments, a method may include fewer, additional, and/or different steps and that the steps may be performed in any order. The method starts at step 900 and, at step 902, it is determined whether the current game is in a betting allowed phase. A player may place one or more wagering units on a surface of a side-bet device at any time, before or after a betting allowed phase. If the game is not currently in a betting allowed phase, the method starts over at step 900 and waits until a betting allowed phase is entered. If the game is currently in a betting allowed phase at step 902, the method proceeds to step 904 and one or more wagering units may be detected on a surface of a side-bet device. The wagering unit(s) may be detected by one or more sensing devices arranged in the side-bet device and may be detected at intervals, continuously, continually, and/or the like. At step 906, the value of the wagering unit(s) may be determined based on data received by the sensing device(s). For example, one or more signals received from the wagering unit(s) may be matched to a predetermined value.

With continued reference to FIG. 6, after the value of the wagering unit(s) placed on the side-bet device is determined at step 906, the value may be displayed on one or more display devices (e.g., a display device facing the player, a separate guest display device, and/or a display device operated by the dealer, etc.). At step 908, the value may be added to the game. As an example, the value may be added as a side-bet wager in an existing game, the value may be added to an electronic player balance that is used to fund a wager, and/or the like. At step 910, the operator of the game removes the wagering unit(s) from the side-bet device. The operator may be prompted to do so by the side-bet device, by the dealer input device and/or another display device, and/or the like. At step 912, the game enters a betting-not-allowed phase during which additional wagers placed on a side-bet device will not be considered for the current game. The betting-not-allowed phase of step 912 may be initiated in response to dealer input or, in other examples, in response to the operator removing the wagering unit(s) from the side-bet device(s). In non-limiting embodiments, entering the betting-not-allowed phase may also be indicated by the dealer making a hand motion over at least two uncovered side-bet devices. In non-limiting embodiments, the order of steps 910 and 912 may be switched. At step 914, the game is conducted by the operator utilizing the wagering unit(s) placed on the side-bet device by a player.

In non-limiting embodiments, provided is a side-bet game that is played in conjunction with the side-bet device described herein and the game of blackjack. This side-bet game offers payouts in three different situations: (1) when the player has a blackjack or a specific blackjack; (2) when the dealer/bank has a blackjack or a specific blackjack; and (3) when situations (1) and (2) occur on the same hand. Situation (2) is beneficial because, when all participants of the side-bet game are winning a bonus at the same time, the luck can be shared by all participating players in the same hand. However, in the base (e.g., principle) blackjack game, the dealer wins all by having a blackjack. In this case, situation (2) serves as player insurance against a dealer blackjack. If both the dealer and player have a specific blackjack, the side-bet payout or jackpot may be won. Players missing the jackpot during that hand will share the luck on the table by profiting from situation (2), since situation (3) for one specific player can only occur when situation (2) occurs for other participating players. In non-limiting embodiments, a dealer bonus may be administered by a single actuation of a button or input on the dealer input device. For example, the bonus may be added to each user's electronic balance associated with a corresponding side-bet device.

In non-limiting embodiments, a dealer input device may facilitate the dealer to provide inputs to side-bet games. For example, in non-limiting embodiments, a dealer input device may include a touch screen input device. During a betting-not-allowed phase of a game, the dealer provides input through the dealer input device which may display player positions that are participating in the side-bet game and the dealer position on which position a relevant gaming event has occurred. For example, in the blackjack side-bet game described above, the relevant gaming event may be a dealer blackjack. Based on the dealer input, the dealer input device may change a layout or indicia of the selected position (e.g., on a display device or on the gaming table) to indicate that a relevant gaming event has occurred at that position. Additional inputs may result in further layout changes or indicia to appear to indicate the different relevant game outcomes for that specific game position. For example, different layouts, colors, and/or indicia may be used at various positions on the dealer input device or another display device to indicate "no blackjack", "a blackjack", "a specific blackjack", or, if applicable, "an even more specific blackjack" as described herein. In addition to the game events being displayed on the various positions, the display may also indicate the game result of the participating players' positions of the side-bet game below or adjacent the indication of the game events at the player positions. The display may be configured to present the game results of each individual participating player position based on the gaming events entered into the system by the dealer. When, for instance, a dealer blackjack has occurred, the dealer input device may indicate that each participating side-bet player has won a prize (e.g., a payout, jackpot, and/or the like) which is associated with that specific gaming event. The system may further indicate in which way the winning amount is distributed to the player. The price distribution may be done by different methods, such as by incrementing the amount of credits on the electronic balance of the payer side-bet device, by providing a payout of wagering units from the dealer tray, or by cashing out a certain currency amount. If applicable, all of these different methods can be combined by the deduction of the applicable Jackpot meters. Typically, the payout methods are preset in the system for each different prize available in the side-bet game. In non-limiting embodiments, a player may deduct all or a portion of the credits on the electronic balance of their side-bet device by a pay-out mechanism via the dealer during the betting-allowed phase. Payouts of the electronic balance can be made by the dealer by providing a payout of wagering units from the dealer tray, or by cashing out a certain currency amount.

Figure 5A:
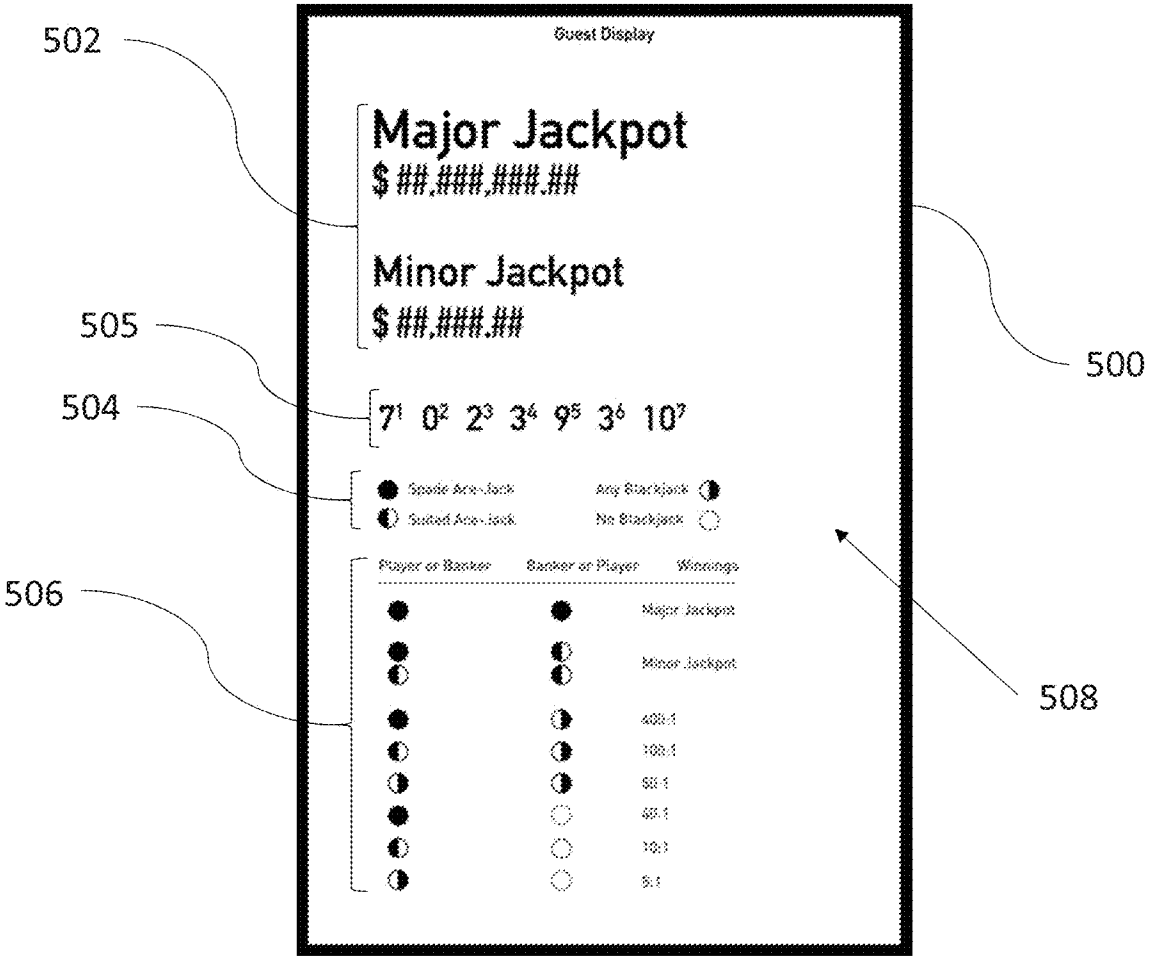
FIG. 5A illustrates a player game display device according to a non-limiting embodiment.

In reference to FIG. 5A, a non-limiting embodiment of a graphic user interface (GUI) for the player game display device 500 is shown. The guest display 508 may show the values of a current Major Jackpot and Minor Jackpot 502. The guest display 508 may also identify different types of blackjacks 504 that the player and dealer may receive during game play. The guest display 508 may also identify various payouts based on different combinations of types of blackjacks received by the player and the dealer 506. In non-limiting embodiments, the separate guest display device 508 may also show the values of the current electronic balance for each side-bet unit 505.

Figure 5B:
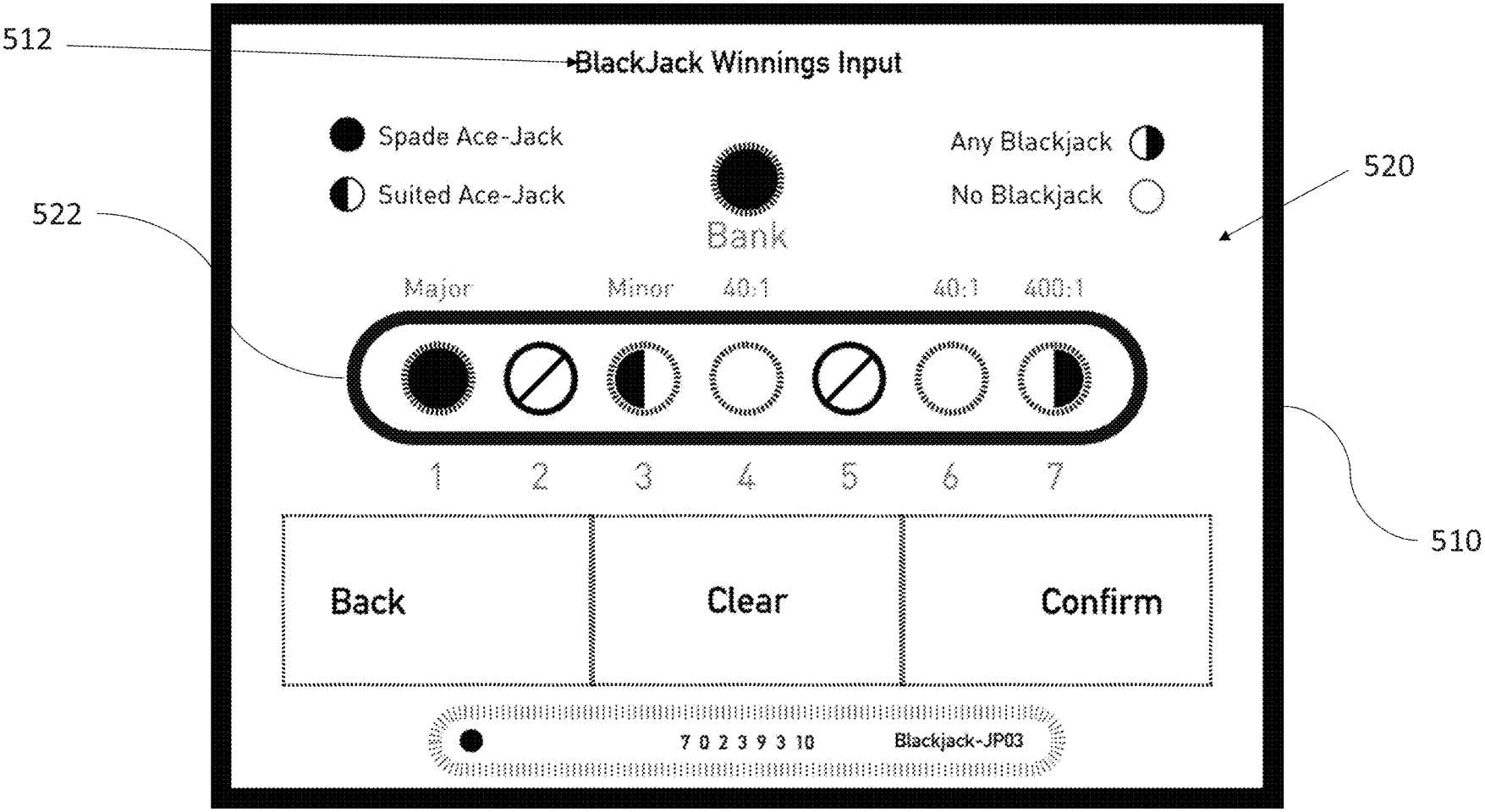
FIG. 5B illustrates a display for a dealer input device displaying Black Jack Winnings inputs according to a non-limiting embodiment.

In reference to FIGS. 5B-5E, non-limiting embodiments of a GUI for a dealer input device 510 is shown. The GUI may have a header 512 which indicates the current input screen of the dealer GUI 510. In the BlackJack Winnings Input screen 520, as shown in FIG. 5B, the dealer GUI 510 may display the types of blackjack found at each seat of the table 522. The dealer GUI may also display the winnings for each seat at the table based on the type of blackjack of the player at the seat, as well as the type of blackjack of the dealer. The BlackJack Winnings Input screen may also display the current electronic balance of each player.

Figure 5C:
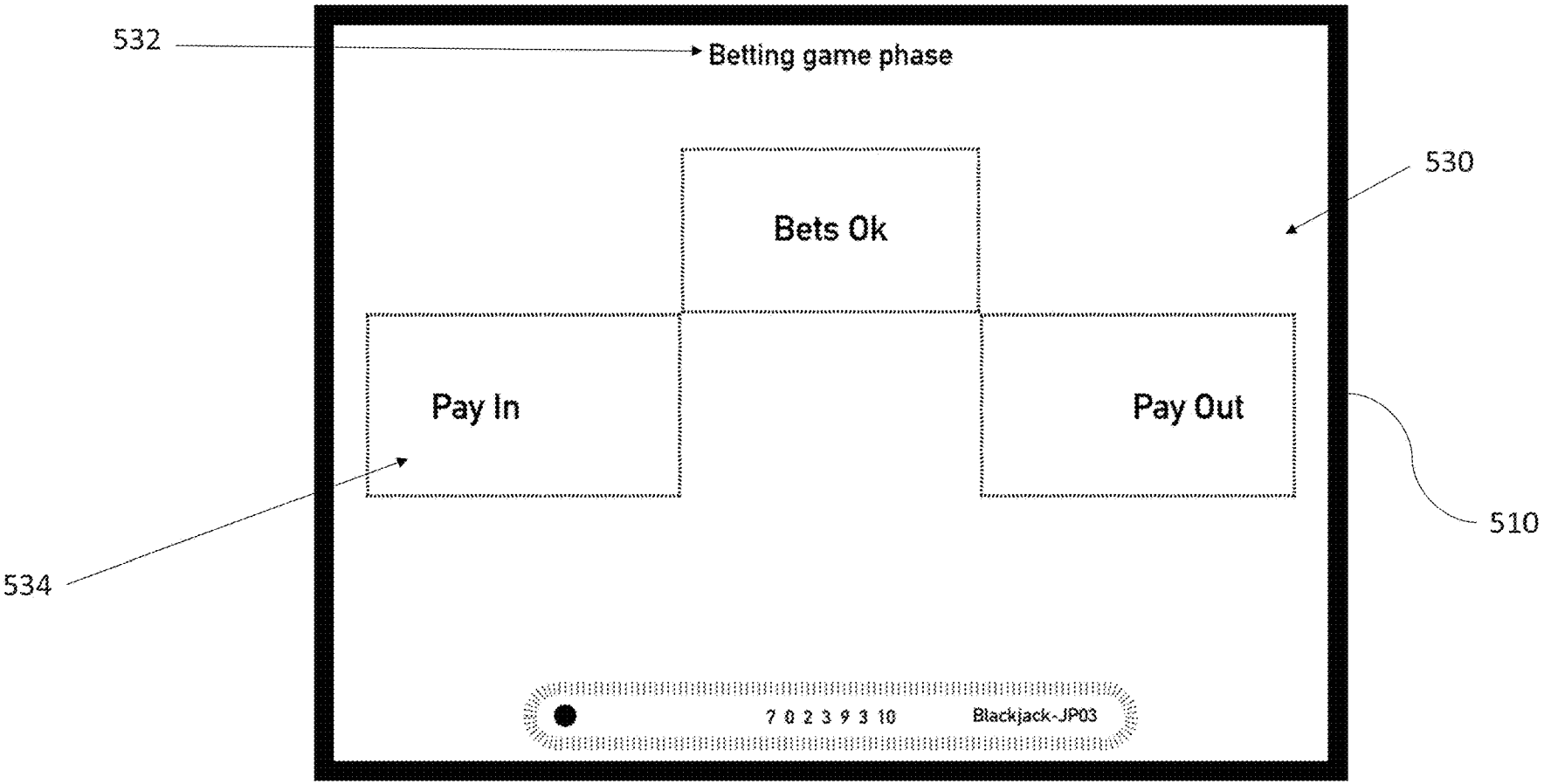
FIG. 5C illustrates a display for a dealer input device displaying betting game phase inputs according to a non-limiting embodiment.

In reference to FIG. 5C, the dealer GUI 510 may display a Betting game phase screen 530. The Betting game phase screen 530 may include a header 532 which displays the game phase. The Betting game phase screen 530 may also include input buttons 534, which may include pay in, bets ok, and pay out. In non-limiting embodiments, the payout button may allow a dealer to deduct all or a portion of the electronic balance of a particular player. The player can then be paid out by the dealer by providing a payout of wagering units from the dealer tray, or by cashing out a certain currency amount. The Betting game phase screen may also display the current electronic balance of each player.

Figure 5D:
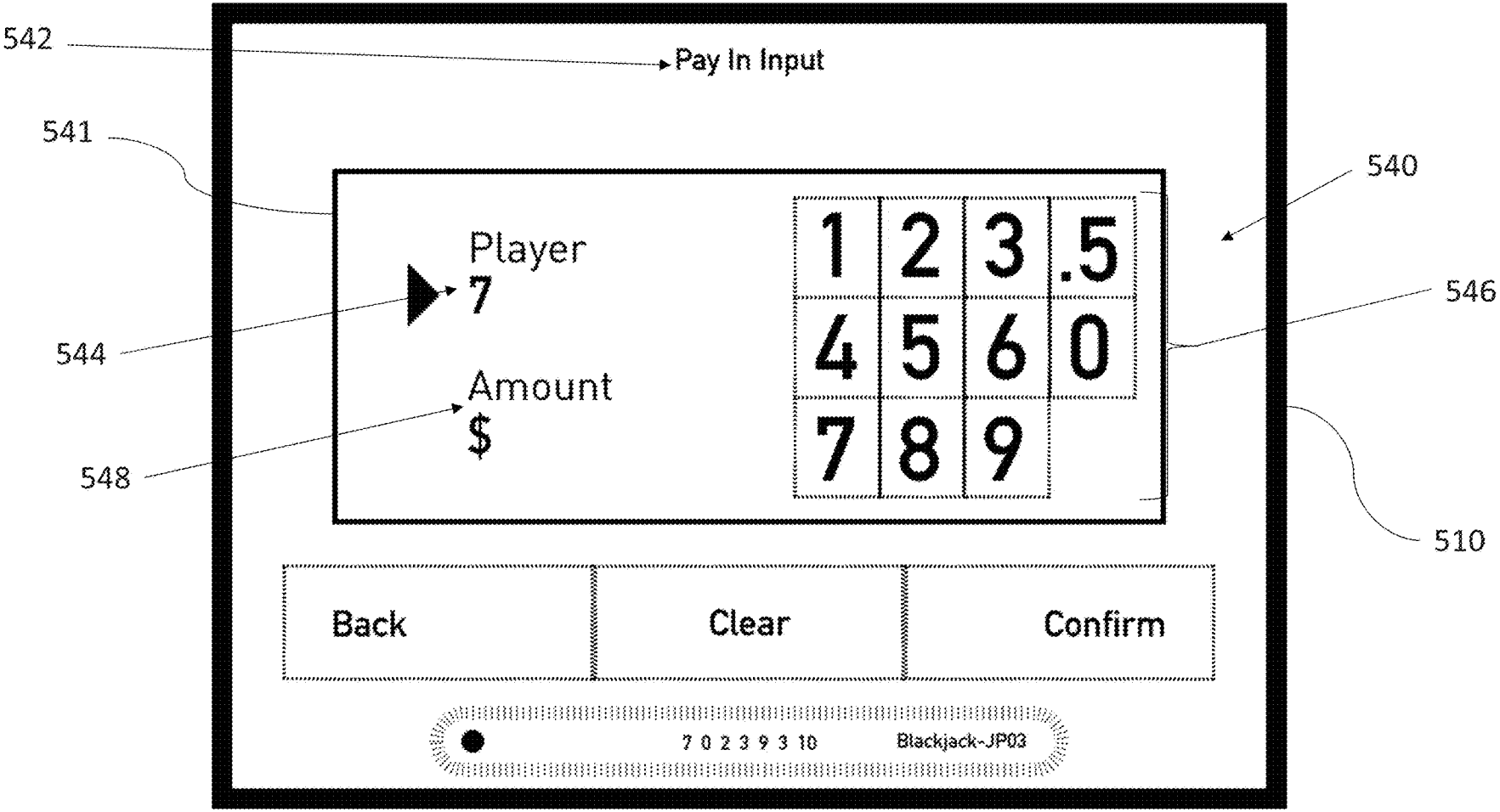
FIG. 5D illustrates a display for a dealer input device according to a non-limiting embodiment.

In non-limiting embodiments, the pay in button on the Betting game phase screen 530 may allow the dealer GUI to display a Pay In Input screen 540 with the Pay In Input heading 542, as shown in FIG. 5D. In non-limiting embodiments, the Pay-In Input screen may contain an input window 541 that contains an input for the player number 544, an input for the amount of pay-in 548, as well as buttons for entering numerals 546. In non-limiting embodiments, the input received through the Pay-In Input screen 540 is used by the side-bet computing device 408 to increase the electronic balance of the players. In non-limiting embodiments, the GUI for the dealer input device 510 may also display the electronic balance for each side-bet unit. The Pay In Input screen may also display the current electronic balance of each player.

Figure 5E:
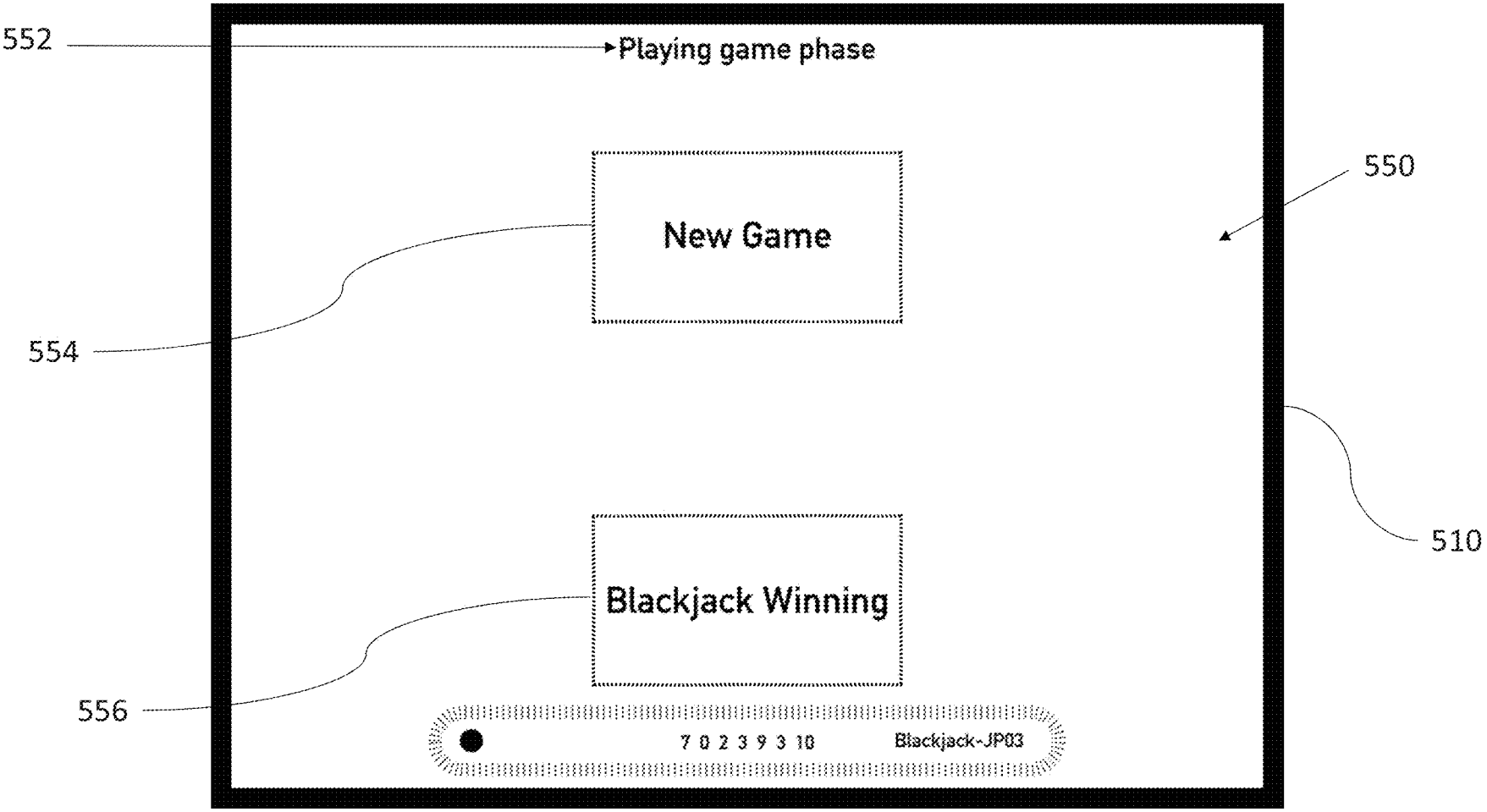
FIG. 5E illustrates a display for a dealer input device displaying playing game phase inputs according to a non-limiting embodiment.

In non-limiting embodiments, the Bets Ok button 534 of the Betting Game Phase screen 530 may change the display of the dealer GUI 510 to display a playing game phase screen 550 with a playing game phase header 552, as shown in FIG. 5E. In non-limiting embodiments, the playing game phase screen 550 may include an input button for new game 554 and an input button for blackjack winning 556. In non-limiting embodiments, the new game button 554 will change the dealer GUI 510 to display the Betting Game Phase screen 530. In non-limiting embodiments, the blackjack winning button 556 will change the dealer GUI 510 to display the Blackjack Winnings Input screen 520. The playing game phase screen may also display the current electronic balance of each player.

The above mentioned side-bet game could also be based on other relevant gaming events, such as another relevant card combination during a blackjack game or any other gaming event of other casino games, where this relevant gaming event can at least occur and is rewarded at each participating player position (situation (1)), at the dealer position (situation (2)), or at both positions at the same time (situation (3)).

Figure 7:
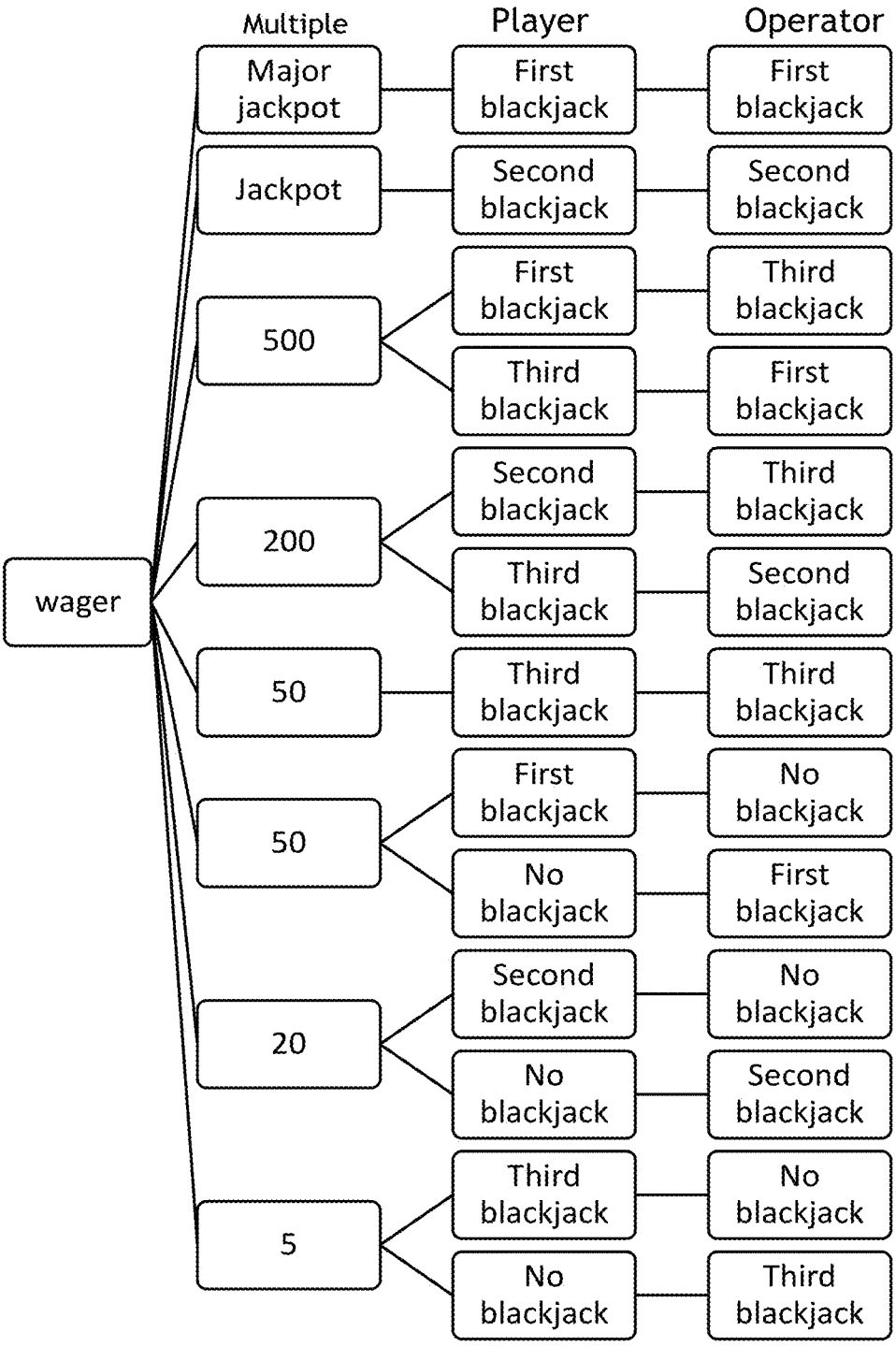
FIG. 7 illustrates an example chart for a blackjack side-bet game according to a non-limiting embodiment.

Referring now to FIG. 7, payouts are shown according to non-limiting embodiments of the above-described side-bet game.

More specifically, the payouts for non-limiting embodiments of the above-described side-bet game in which the specific blackjack is, for exemplary purposes only, a blackjack consisting of a black-suited Ace and a black-suited Jack, are as follows:

Jackpot: player and dealer have a blackjack (situation 3), both blackjacks consist of a suited Ace-Jack combination, starting at a value of 2,000:1;

Bonus 1: both player and dealer have a blackjack (situation 3) while only one of them has a blackjack which contains a suited Ace-Jack combination to be paid 200:1;

Bonus 2: both player and dealer have a blackjack (situation 3) while none of them has a blackjack contain a suited Ace-Jack combination to be paid 50:1;

Bonus 3: the player (situation 1) OR the dealer (situation 2) has a blackjack consisting of a suited Ace-Jack combination, both situations to be paid 20:1; and Bonus 4: the player (situation 1) OR the dealer (situation 2) has a blackjack not consisting of a black-suited Ace combined with a black-suited Jack, both situations to be paid 5:1.

Other payouts according to non-limiting embodiments the above-described blackjack side-bet game allow an even higher jackpot payout, using the specific blackjack as described above and additionally using an even more specific blackjack consisting of a spade Ace and a spade Jack is as follows:

A Major Jackpot: player and dealer have a blackjack (situation 3), both blackjacks consist of a spade Ace combined with a spade Jack, starting at a value 20,000:1;

A second minor Jackpot or an extra high bonus: player and dealer have a blackjack (situation 3), both blackjacks consist of a suited Ace-Jack combination, starting at a value 1,000:1;

Bonus 1: both player and dealer have a blackjack (situation 3) while only one of them has a blackjack which contains a spade Ace, and spade Jack to be paid 500:1;

Bonus 2: both player and dealer have a Blackjack (situation 3) while only one of them has a blackjack which contains a suited Ace-Jack combination to be paid 200:1;

Bonus 3: both player and dealer have a blackjack (situation 3) while none of them has a blackjack containing a suited Ace-Jack combination to be paid 50:1;

Bonus 4: the player (situation 1) OR the dealer (situation 2) has a blackjack consisting of a spade Ace combined with a spade Jack, both situations to be paid 50:1;

Bonus 5: the player (situation 1) OR the dealer (situation 2) has a blackjack consisting of a suited Ace-Jack combination, both situations to be paid 20:1; and Bonus 6: the player (situation 1) OR the dealer (situation 2) has a blackjack not consisting of a black-suited Ace combined with a black-suited Jack, both situations to be paid 5:1.

Using the same bonuses, other payouts are possible as well. The payouts mentioned are only for illustration purposes. In a non-limiting embodiment, a display device (e.g., as part of the side-bet device or otherwise) shows side-bet winning ratio information to the players on the gaming table. It is appreciated that the dealer can choose any variation of side-bet winnings on the dealer input device. It is also appreciated that the side-bet device can be used for games other than blackjack and its variations, for example poker.

In non-limiting embodiments, when the wager is modified to increase the wager amount, the wager amount will be increased by the multiples of a range of values or by fixed values. In non-limiting embodiments, the multiples of a range of values include any number, including a range from 2 to 500, and the fixed values include Jackpot and Major Jackpot. Specific values from the range of 2 to 500 are chosen as the multiple to increase the value of the wager. Specific values may be chosen in certain circumstances involving a first blackjack, second blackjack, and third blackjack. The first blackjack consists of a spade Ace and a spade Jack. The second blackjack consists of a suited Ace-Jack combination. The third blackjack of any other valid blackjack combination.

In non-limiting embodiments, the value "500" is chosen as the multiple to increase the wager when the player has the first blackjack and the dealer has the third blackjack or when the player has the third blackjack and the dealer has the first blackjack. The value "200" is chosen as the multiple to increase the wager when the player has the second blackjack and the dealer has the third blackjack or when the player has the third blackjack and the dealer has the second blackjack. In non-limiting embodiments, the value "50" is chosen as the multiple to increase the wager when the player has the first blackjack and the dealer does not have any of the three blackjacks or when the player does not have any of the three blackjacks and the dealer has the first blackjack. Value "20" is chosen as the multiple to increase the wagering unit when the player has the second blackjack and the dealer does not have any of the three blackjacks or when the player does not have any of the three blackjacks and the dealer has the second blackjack. Value "5" is chosen as the multiple to increase the wagering unit when the player has the third blackjack and the dealer does not have any of the three blackjacks or when the player does not have any of the three blackjacks and the dealer has the third blackjack. In other non-limiting embodiments, Major Jackpot is chosen as the value when both the player and the dealer have the first blackjack. Jackpot is chosen when both the player and the dealer have the second blackjack. It will be appreciated that any value may be selected as multiples to increase the wager by.

In non-limiting embodiments, another payout includes a mystery jackpot. A winner of the mystery is selected at random by the computing device 414. In non-limiting embodiments, the winner is identified through the visual indicators 104. The mystery jackpot value may be determined at random by the computing device 414. In non-limiting embodiments, when multiple tables are connected through the computing device 414, an entire table may be selected to be winners of the mystery jackpot.

In non-limiting embodiments, the player allocates a portion of the value of the wagering unit before a game is initiated by the dealer. When a player allocates a value, the allocated value is a portion or all of the electronic balance which is reserved for participation in the upcoming game. However, the player does not have to allocate a portion of the value of the wagering unit for each initiated game of blackjack. In other non-limiting embodiments, the allocated portion of the value of the wagering unit may displayed on the display device. In non-limiting embodiments, both the total amount of the value of the wagering unit and the allocated portion of the value of the wagering unit are displayed on the display device simultaneously. The value of the allocated device and the total value of the wagering unit can be displayed one at a time. In non-limiting embodiments, the allocated portion of the wagering unit is displayed after a game is initiated, and the total value of the wagering unit is displayed before a game is initiated. In other non-limiting embodiments, the pre-determined values are also displayed on the display device. In non-limiting embodiments, the allocated value is deducted from the electronic balance when entering the betting-not-allowed phase.

In non-limiting embodiments, after a game is finished and before the next game is initiated, the modified value of the wagering unit is displayed on the display device. When the total value of the wagering unit and the allocated portion of the wagering unit are simultaneously displayed on the display device, the allocated portion of the wagering unit is modified. When the allocated value of the wagering unit is increased by a pre-determined amount, the display device displays the value of the multiple of the wagering unit and the pre-determined amount or a fixed amount where the allocated portion of the wagering unit was displayed. Then, the display device may display the value of the sum of the total value of the wagering unit and the modified allocated wagering unit where the total value of the wagering unit was displayed, and the display device may no longer display a value for an allocated portion of the wagering unit until the player allocates a portion of the wagering unit from the total value of the wagering unit. In non-limiting embodiments, it will be appreciated that the dealer can manually change the displayed value of the total value of the wagering unit, allocated portion of the wagering unit, and the modified value of the wagering unit, as well as the modified value of the allocated portion of the wagering unit.

Figure 8:
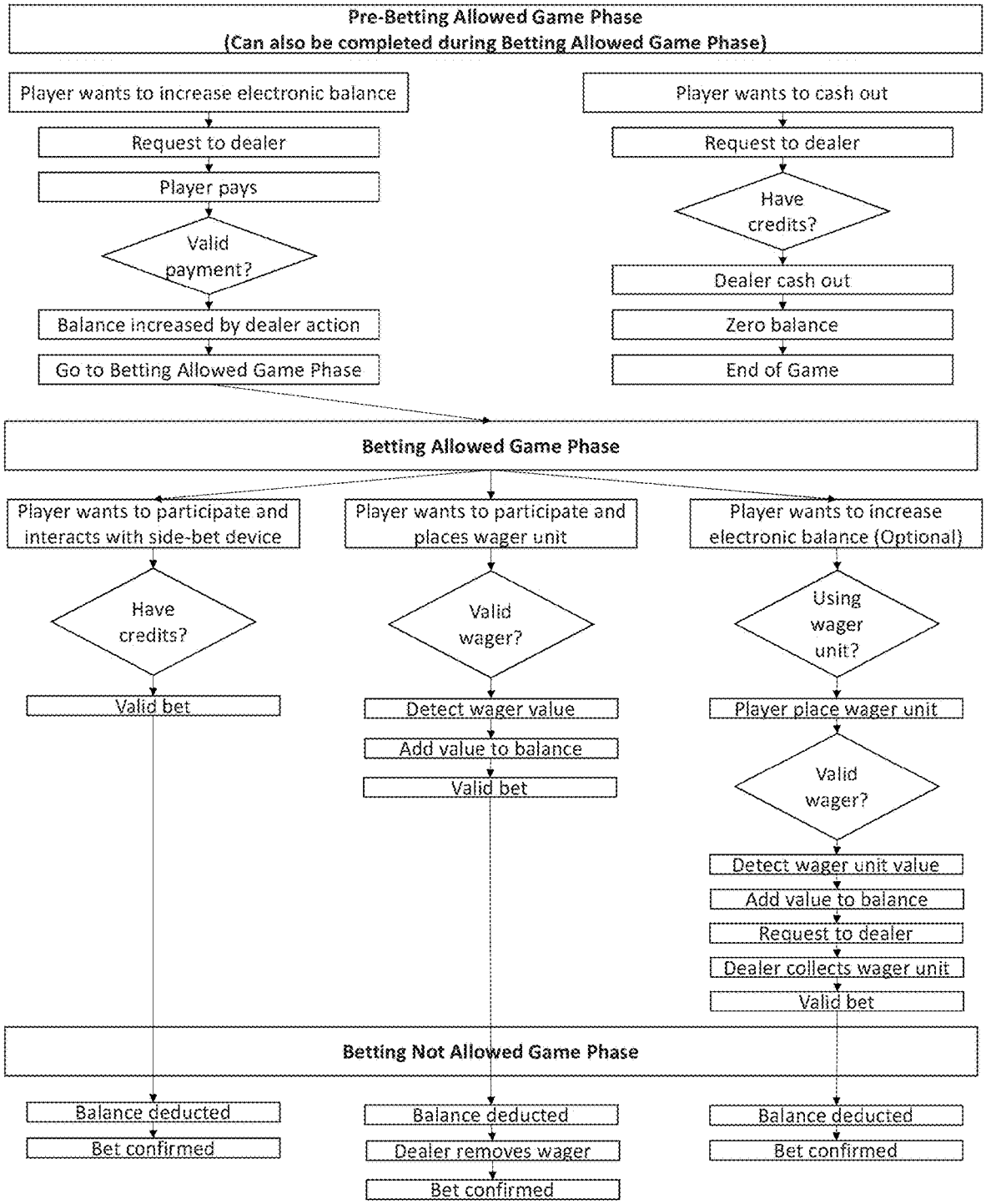
FIG. 8 illustrates non-limiting embodiments of game phases for a game that may be played in connection with the side-bet device.
Figure 9:
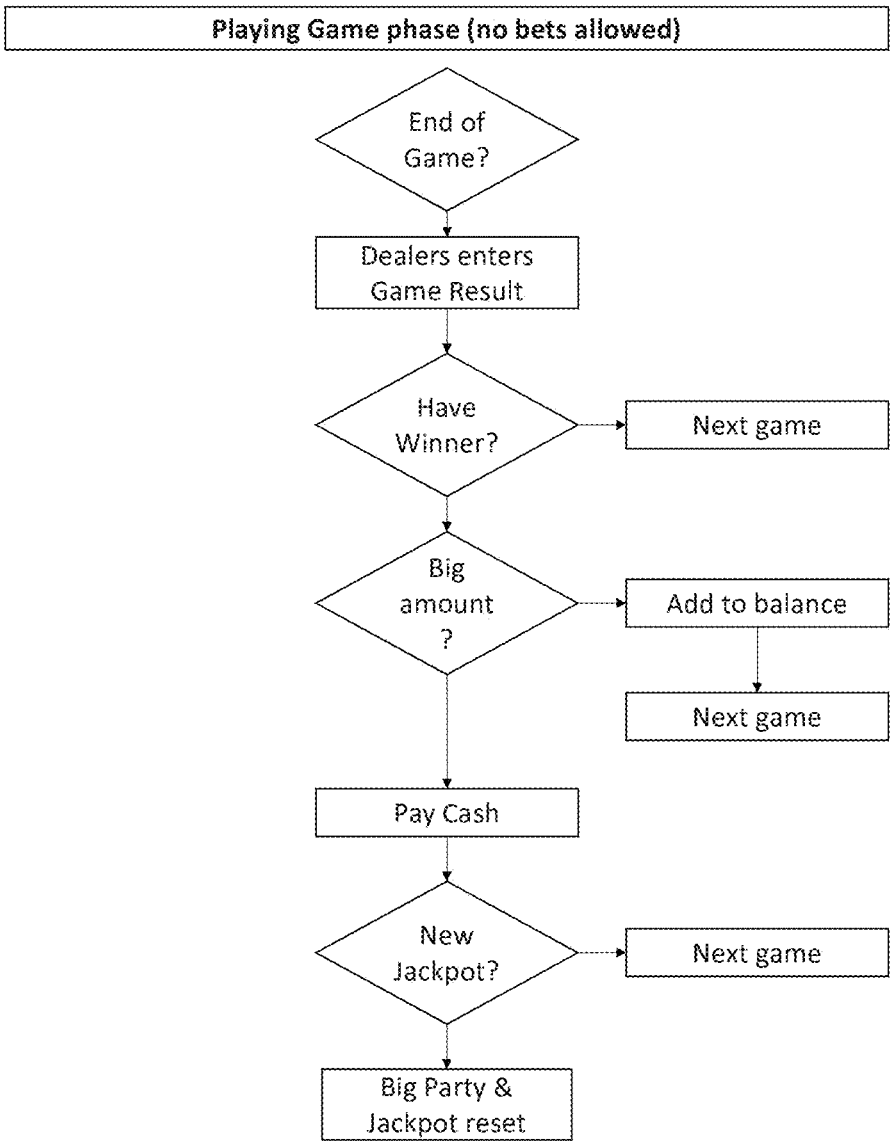
FIG. 9 illustrates a non-limiting embodiment of a game phase for a game that may be played in connection with the side-bet device.

FIGS. 8 and 9 represent non-limiting embodiments of game phases for a game that may be played in connection with the side-bet device described herein. It will be appreciated that the flow shown in FIGS. 8 and 9 are for example purposes only and that a variety of different games can be played in connection with the side-bet device described herein. In reference to FIG. 8, during the pre-betting allowed game phase, a player may either increase their electronic balance or cash out. When a player wants to increase their electronic balance, the player will make a request to the dealer to increase the balance. The player then makes a payment to the dealer. The dealer may confirm that the payment is valid. If the payment is valid, the dealer may take an action to increase the player's electronic balance.

In further reference to FIG. 8, when a player wants to cash out, the player may make a request to the dealer to cash out. The dealer may confirm if the player has credits in their electronic balance. If the player does have credits in their electronic balance, the dealer may cash out the player. The dealer may zero out the electronic balance of the player after the cash out, using a dealer display device. The player may then be considered to not be participating in the game.

In further reference to FIG. 8, a player may also request to cash out or increase his/her electronic balance through payment during the betting-allowed game phase. It may also be possible for the player to increase their balance during the playing game phase. This may be done, for example, if an additional balance is necessary to complete an action in the game (e.g., split cards or double down in a game of blackjack).

In further reference to FIG. 8, during the betting-allowed phase, a player may increase their electronic balance through the use of wagering units. The player may also participate in the game through interacting with the side-bet device or placing one or more wager units on the side-bet device. If the player wishes to increase their electronic balance through wagering units, the player may place one or more wagering units on the side-bet device. The value of the wagering unit is then detected. The value of the wagering unit will be added to the electronic balance of the player. A request is sent to the dealer to remove the wagering unit. It is then determined if the bet is valid. If the bet is valid, the player can continue to the betting-not-allowed game phase. In non-limiting embodiments, the betting-not-allowed game phase may occur after an indication from the dealer. This indication may take the form of an input in the dealer input device or by making a hand motion over at least two uncovered side-bet devices. In the betting-not-allowed game phase, the electronic balance of the player is deducted by the value of the bet. The bet may then be confirmed by the device. The player may then enter the playing game phase.

In further reference to FIG. 8, if the player wants to participate in the game through placing of one or more wagering units, the player may place the wagering unit(s) on the side-bet device. The device may check the wagering unit(s) to determine if the wager is valid. If the wager is valid, the device will detect the value of the wagering unit(s). The value may then be added to the electronic balance of the player. The device may then check to ensure that the bet made is valid. This may include ensuring the bet meets or exceeds a predetermined minimum bet. This may also include ensuring the bet does not exceed a predetermined maximum bet. If the bet is valid, the player can continue to the betting-not-allowed game phase. In non-limiting embodiments, the betting-not-allowed game phase may occur after an indication from the dealer. This indication may take the form of an input in the dealer input device or by making a hand motion over at least two uncovered side-bet devices. In the betting-not-allowed game phase, the electronic balance of the player is deducted by the value of the bet. The dealer may then remove the wagering unit(s) from the side-bet device. The bet may then be confirmed by the device. The player may then enter the playing game phase.

In further reference to FIG. 8, if the player wants to participate in the game through interacting directly with the side-bet device, the device may check if the player has a sufficient amount of credits in their electronic balance. If there is a sufficient amount of credits, the device will check if the bet is valid. This may include ensuring the bet meets or exceeds a predetermined minimum bet. This may also include ensuring the bet does not exceed a predetermined maximum bet. If the bet is valid, the player can continue to the betting-not-allowed game phase. In non-limiting embodiments, the betting-not-allowed game phase may occur after an indication from the dealer. This indication may take the form of an input in the dealer input device or by making a hand motion over at least two uncovered side-bet devices. In the betting-not-allowed game phase, the electronic balance of the player is deducted by the value of the bet. The bet may then be confirmed by the device. The player may then enter the playing game phase.

Once the dealer determines that all bets are confirmed, the game may enter the Playing Game phase. In reference to FIG. 9, the dealer will determine if the game is over. If the game is over, the dealer will enter the game results. If there are no game results to be entered, the dealer may skip entering the game results and go directly to the next game. If there are no winners, the next game can begin. If there is a winner, it will be determined if the winner has won a large sum (e.g., greater than a predetermined threshold). If the winning sum is not large, the winnings are added to the player's balance and the next game can begin. If the winning sum is large, the winner is paid in cash. If no new jackpot is needed, the next game can begin. It will be appreciated that these steps may vary depending on the game implementation. Steps may also vary depending on requirements of the house, the casino-operator, or the specifications.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A side-bet device comprising:

a housing having a surface;

at least one sensing device arranged in the housing and configured to generate sensing device data based on at least one input received through the surface;

a display device arranged in the housing and configured to display an electronic balance through the surface; and a computing device internal or external to the housing, the computing device in communication with the at least one sensing device and the display device, the computing device configured to:

detect a first input type from the surface based on the sensing device data received from the at least one sensing device during a betting-allowed phase, the first input type comprising a placement of a wagering unit on the surface;

detect a second input type from the at least one sensing device based on the sensing device data received from the at least one sensing device during the betting-allowed phase, the second input type comprising a placement of a user's appendage or portion thereof on or within sensing device range of the at least one sensing device;

participate in a game by initiating a wager based on detecting the wagering unit; and participate in the game by initiating the wager based on transferring a value of the wager from the electronic balance.

2. The side-bet device of claim 1, wherein the at least one sensing device comprises an infrared transmitter and receiver configured to transmit a signal to be reflected by an object placed on or near the sensing device.

3. The side-bet device of claim 2, wherein the first input type comprises a reflection of the signal for a first period of time, and wherein the second input type comprises a reflection of the signal for a second period of time shorter than the first period of time.

4. The side-bet device of claim 2, wherein the signal comprises a modulated infrared signal.

5. The side-bet device of claim 1, wherein the at least one sensing device comprises a receiver and a transmitter, wherein the transmitter is configured to emit a radiation that is at least partially reflected by the wagering unit, wherein the receiver is configured to detect the radiation after being reflected, and wherein a value of the wagering unit is determined based on the radiation.

6. The side-bet device of claim 5, wherein the transmitter comprises at least one of: an RGB-LED, a white light LED, or any combination of visual light, and wherein the receiver comprises at least one of: a luminous sensing device, a color sensing device, a camera, an image sensor, or any combination of sensors that receive visual light.

7. The side-bet device of claim 1, wherein the computing device is further configured to add a value to the electronic balance in response to detecting the first input type.

8. The side-bet device of claim 1, wherein the sensing device comprises a radio frequency receiver, and wherein the first input type comprises a signal from at least one wagering unit having a radio frequency transmitter embedded therein.

9. The side-bet device of claim 1, wherein at least a portion of the surface is angled with respect to a table surface on which the side-bet device is located, and wherein the at least a portion of the surface is adapted for receiving a wagering unit placed on it.

10. The side-bet device of claim 9, wherein the at least a portion of the surface comprises a raised portion arranged over the at least one sensing device, wherein the raised portion is angled with respect to a flat portion of the surface, and wherein the raised portion comprises a side surface comprising a second display device.

11. The side-bet device of claim 1, wherein the computing device is further configured to detect a second input type from the at least one sensing device based on the sensing device data received from the at least one sensing device, the second input type comprising a placement of a user's appendage or portion thereof on or within sensing device range of the at least one sensing device, wherein the computing device is further configured to transfer a value from the electronic balance to a separate side-bet electronic balance in response to the first input type or the second input type, and wherein the display device is further configured to display the separate side-bet balance.

12. The side-bet device of claim 1, wherein the computing device comprises a first computing device arranged in the housing and a second computing device in communication with a plurality of side-bet devices, wherein the second computing device is located external to the housing.

13. The side-bet device of claim 1, further comprising at least one visual indicator arranged on or in the housing, the at least one visual indicator configured to display a plurality of different visual states in response to input from the user or the computing device.

14. A computer program product for operating a side-bet game, comprising at least one non-transitory computer-readable medium including program instructions that, when executed by at least one processor, cause the at least one processor to:

enter a betting-allowed phase of a game based on input received through a dealer input device, wherein a plurality of side-bet devices are in communication with the dealer input device;

display, on a display device, an electronic balance on a side-bet device used during the side-bet game;

during the betting-allowed phase, detect, with at least one sensing device arranged under a surface of the side-bet device, a first input type from the surface comprising a placement of at least one wagering unit on the surface;

during the betting-allowed phase, detect a second input type comprising a placement of a user's appendage or portion thereof on or within sensing device range of the at least one sensing device;

determine a value of the at least one wagering unit based on sensing device data received from the at least one sensing device;

in response to a player input to wager from the at least one wagering unit, allocate the value or a portion thereof for the side-bet device to a side-bet of a primary game being conducted;

in response to a player input to wager from the electronic balance, allocate at least a portion of the electronic balance for the side-bet device to the side bet; and enter a betting-not-allowed phase, wherein further input from the surface during the betting-not-allowed phase is not registered as a wager or an addition to the electronic balance, and wherein entering the betting-not-allowed phase comprises registering the allocated value as a wager to be used in the side-bet game.

15. The computer program product of claim 14, wherein the program instructions, when executed, further cause the at least one processor to activate at least one visual indicator to display a different visual state based on whether a wager is allocated to the side-bet through each side-bet device, and wherein the different visual state is changed to a further visual state in response to entering the betting not allowed phase.

16. A method for operating a side-bet game, comprising:

entering, with at least one processor, a betting-allowed phase of a game based on input received through a dealer input device;

during the betting-allowed phase, detecting, with at least one sensing device arranged under a surface of a side-bet device, a first input type from the surface comprising a placement of at least one wagering unit on the surface;

during the betting-allowed phase, detect a second input type comprising a placement of a user's appendage or portion thereof on or within sensing device range of the at least one sensing device;

determining, with at least one processor, a value of the at least one wagering unit based on sensing device data received from the at least one sensing device;

transferring, with at least one processor, the value from the at least one wagering unit to an electronic player balance of the side-bet device;

registering participation in a side-bet game based on user input on the surface; and entering, with at least one processor, a betting-not-allowed phase in response to input received through a dealer input device, wherein further user input from the surface on the side-bet device during the betting-not-allowed phase is not registered as a wager or an addition to the electronic player balance, and wherein entering the betting-not-allowed phase comprises deducting at least a portion of the value added to the electronic player balance of the side-bet device.

17. The method of claim 16, wherein detecting the first input type comprises:

transmitting, from a transmitter, a signal to the surface of the side-bet device; and receiving, from the surface by the at least one sensing device, a reflection of the signal.

18. The method of claim 16, wherein detecting the first input type comprises:

transmitting, from a transmitter, a signal to the surface of the side-bet device; and receiving, from the surface by the at least one sensing device, a second signal responsive to the signal.

19. The method of claim 16, wherein participation in the side-bet game is registered in response to determining there are sufficient credits on the electronic player balance to participate in the side bet game.

* * * * *